US005557705A

United States Patent [19]

Taguchi

[11] Patent Number: 5,557,705

[45] Date of Patent: Sep. 17, 1996

[54] LOW BIT RATE SPEECH SIGNAL TRANSMITTING SYSTEM USING AN ANALYZER AND SYNTHESIZER

[75] Inventor: Tetsu Taguchi, Tokyo, Japan

[73] Assignee: NEC Corporation, Tokyo, Japan

[21] Appl. No.: 985,138

[22] Filed: Dec. 3, 1992

[30] Foreign Application Priority Data

Dec. 3, 1991 [JP] Japan ..... 3-319427

[51] Int. Cl.[6] ..... G10L 3/02

[52] U.S. Cl. ..... 395/2.28; 395/2.29; 395/2.25

[58] Field of Search ..... 395/2.13, 2.28, 395/2.29, 2.25, 2.26, 2.27; 381/29–40

[56] References Cited

U.S. PATENT DOCUMENTS

| | | | |
|---|---|---|---|
| 4,720,865 | 1/1988 | Taguchi | 381/49 |
| 4,937,868 | 6/1990 | Taguchi | 381/38 |
| 4,975,955 | 12/1990 | Taguchi | 381/36 |
| 5,001,759 | 3/1991 | Fukui | 381/38 |
| 5,228,086 | 7/1993 | Morii | 381/36 |
| 5,305,421 | 4/1994 | Li | 395/2.28 |

OTHER PUBLICATIONS

Hamming, R. W.—Digital Filtering, 1983, pp. 100–105, sec 5.7.

Parsons, Thomas; *Voice and Speech Processing,* 1986, pp. 64–65, 197–198.

E. F. Depretter et al, "Regular Excitation Reduction For Effective and Efficient LP–Coding of Speech", ICASSP, 1985, pp. 965–968.

*Primary Examiner*—Allen R. MacDonald
*Assistant Examiner*—Indranil Chowdhury
*Attorney, Agent, or Firm*—Sughrue, Mion, Zinn, Macpeak & Seas

[57] ABSTRACT

In a speech signal encoding system comprising an analyzer and a synthesizer, the analyzer is supplied with an input analog signal to preliminarily select a sequence of digital signals within an analysis frame, to extract a sequence of excitation pulses, from the analysis frame which is divided into a plurality of time intervals each of which is subdivided into a plurality of phases, correlations are calculated between autocorrelations of impulse responses within the analysis frame and cross correlations between the digital signals and the impulse responses to detect, by a maximum similarity series searching circuit, the sequence of the excitation pulses which has a maximum similarity between the autocorrelation coefficients and the cross correlations. The excitation pulses appear at an equidistant time interval and an identical amplitude and have a selected one of the phases and variable polarities. The excitation pulses are sent to the synthesizer together with a phase signal representative of the selected phase, an amplitude signal determined by the analyzer, and a sequence of LPC parameters calculated in relation to the analysis frame.

10 Claims, 7 Drawing Sheets

LOW BIT RATE SPEECH SIGNAL TRANSMITTING SYSTEM USING AN ANALYZER AND SYNTHESIZER

BACKGROUND OF THE INVENTION

This invention relates to a speech encoding system for use in encoding and decoding a speech signal by the use of a regular pulse excitation technique and, in particular, to an analyzer and a synthesizer for analyzing and synthesizing the speech signal.

A conventional speech encoding system of the type described is disclosed in an article contributed by Ed. F. Depretter and Peter Kroon to ICASSP, 1985 and proposed under the title of "Regular Excitation Reduction for Effective and Efficient LP-Coding of Speech" (pages 965 to 968). The proposed system is referred to as a regular pulse excitation system and is effective to encode a waveform of the speech signal, differing from a multipulse excitation system based on a spectrum analysis of a speech signal, as proposed by Atal et al. The regular pulse excitation system comprises an analysis side (namely, an analyzer) and a synthesis side (namely, a synthesizer) for analyzing and synthesizing the speech signal, respectively. More specifically, an input speech signal is subjected to linear predictive coding (LPC) to obtain a sequence of linear predictive coding (LPC) coefficients and to represent an envelope of the input speech signal. In addition, the speech signal of an exciting source is specified in the analyzer by a sequence of impulses which are arranged at an equal time instant and which are variable in phases and amplitudes. At any rate, the impulse sequence is delivered from the analyzer to the synthesizer as a part of analyzed data signals.

With this system, it is possible to faithfully reproduce the speech signal in the synthesizer as compared with the multipulse excitation system because the waveform of the speech signal itself is reproduced in the synthesizer. As a result, a reproduced speech signal naturally sounds without any unevenness. This means that a speech quality is improved in the regular pulse excitation system in comparison with the multipulse excitation system. In other words, the regular pulse excitation system has a speech quality which is not varied in dependence on sounds of persons and which is invariable.

However, the conventional regular pulse excitation system should encode a set of the analyzed data signals at a rate which is equal to or higher than 9.6 kb/s. Accordingly, it is difficult to transmit such analyzed data signals at a low bit rate lower than 9.6 kb/s.

On the other hand, a recent requirement is to transmit the analyzed data signals at a very low bit rate, such as 2.4 kb/s, to effectively utilize a transmission path.

SUMMARY OF THE INVENTION

It is an object of this invention to provide a speech encoding system which is capable of faithfully reproducing a speech signal at a very low bit rate, such as 2.4 kb/s.

It is another object of this invention to provide an analyzer which is used in the speech encoding system mentioned above and is capable of reducing a bit rate or coding rate when a speech signal is analyzed.

It is still another object of this invention to provide a synthesizer which is communicable with the above-mentioned analyzer and which is capable of faithfully reproducing the speech signal even when the speech signal is specified by a very low bit rate, A speech signal analyzer to which this invention is applicable is for use in analyzing an input speech signal to produce a sequence of transmission data signals which appears as a result of an analysis of the input speech signal in the speech signal analyzer. In one aspect of this invention the speech signal analyzer comprises the following parts:

a. a preliminary processor which is supplied with an input speech signal to be preliminarily processed such that the input speech signal produces a sequence of digital signals which is extracted from the input speech signal and which is arranged within an analysis frame having a pre-determined frame time interval;

b. a parameter calculator which functions to calculate a sequence of pre-selected parameters at the analysis frame as regards the input speech signal to produce a parameter signal representative of the pre-selected parameter sequence;

c. an impulse response calculator which is supplied with the parameter signal for calculating impulse responses with reference to the parameter signal;

d. a cross correlation coefficient calculator which is supplied with the impulse response and the digital signal sequence and which functions to calculate cross-correlation coefficients between the impulse responses and the digital signal sequence within the analysis frame to produce cross-correlation coefficient signals representative of the cross-correlation coefficients;

e. an autocorrelation coefficient calculator which functions to calculate a series of autocorrelation coefficients of the impulse responses;

f. a maximum similarity series extractor which is coupled to the cross correlation coefficient calculator and the autocorrelation coefficient calculator and which functions to extract a series of excitation pulses which appears at an equidistant time interval and an identical amplitude, and which is defined by a phase and polarities such that the excitation pulse sequence exhibits a maximum similarity to the cross correlation coefficient signals. The maximum similarity series extracting means produces the series of the excitation pulses and a phase signal representative of the phase. The analyzer further comprises transmitting means responsive to the series of the excitation pulses, the phase signal, and the parameter signal for transmitting the transmission data signal sequence in relation to the series of the excitation pulses and the phase signal together with the parameter signal.

According to another aspect of this invention, a speech signal synthesizer is communicable with the speech signal analyzer mentioned above and comprises exciting source signal reproducing means for reproducing exciting source information on the basis of the pulse phase signal and the polarity signal included in the transmission data signal sequence, parameter reproducing means for reproducing the parameter signals from the transmission data signal sequence to produce reproduced parameter signals, and synthesizing means coupled to the exciting source signal reproducing means, and the parameter reproducing means for synthesizing a sequence of reproduced digital speech signals from the exciting source signal with reference to the reproduced parameter signals.

DESCRIPTION OF THE PREFERRED EMBODIMENTS

Figure 1:
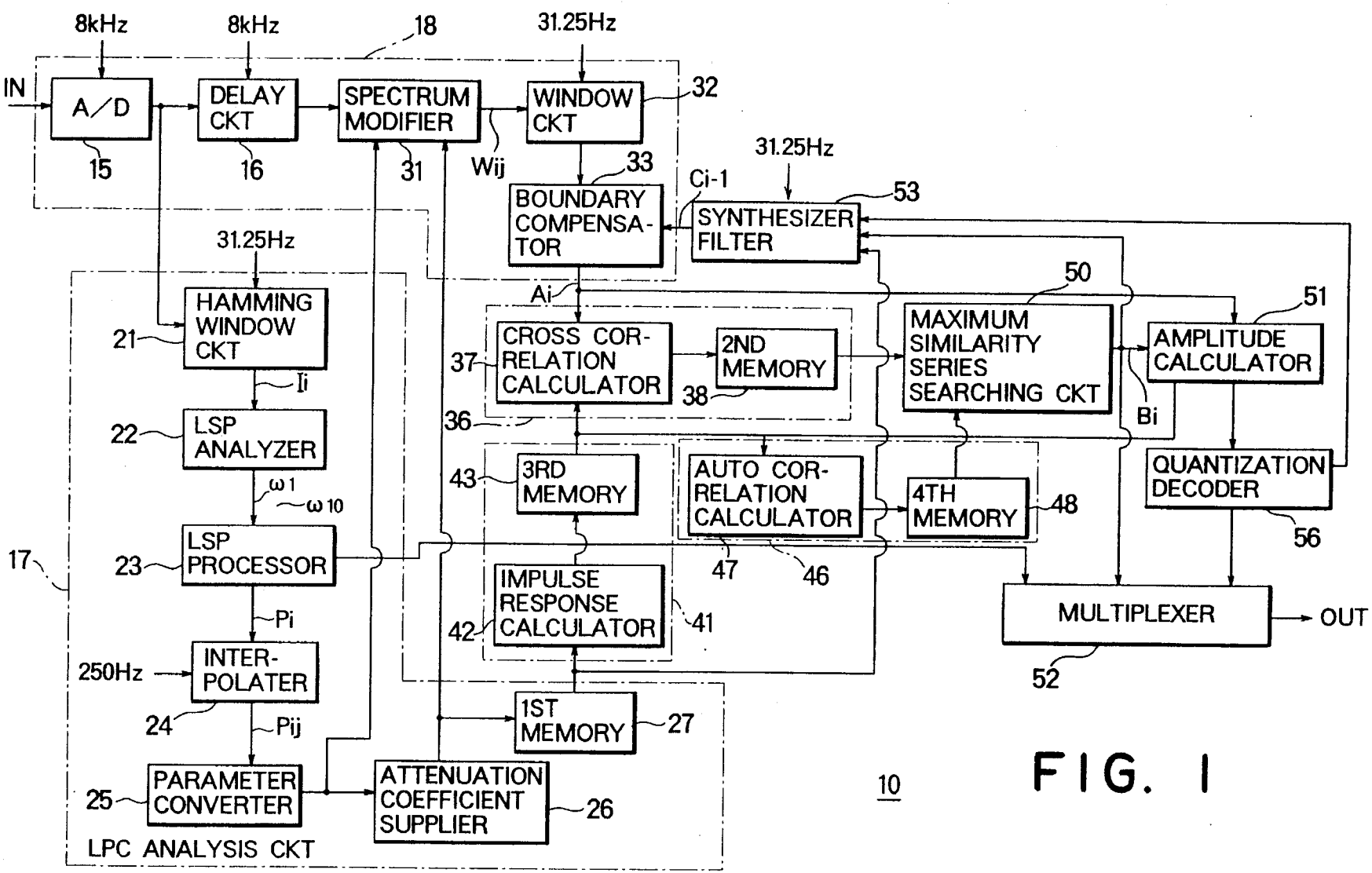
FIG. 1 is a block diagram of a speech signal analyzer according to a preferred embodiment of this invention.
Figure 2:
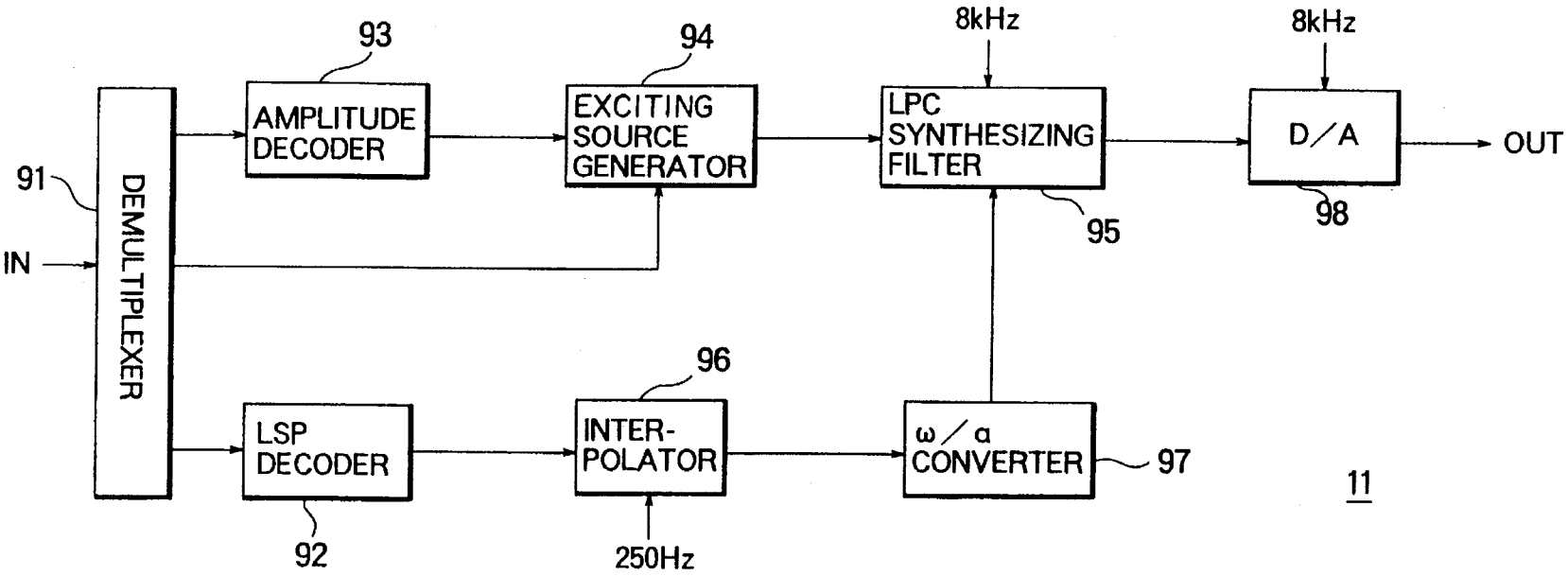
FIG. 2 is a block diagram of a speech signal synthesizer communicable with the speech signal analyzer illustrated in FIG. 1.

Referring to FIGS. 1 and 2, a speech encoding system comprises an analyzer 10 and a synthesizer 11 illustrated in FIGS. 1 and 2, respectively. In FIG. 1, the analyzer 10 is supplied with an input speech signal IN. The input speech signal IN is given to an analog-to-digital (A/D) converter 15 in the form of an analog signal which is subjected to band restriction and which is limited within a frequency range not higher than 3.4 kHz. The A/D converter 15 samples the input speech signal IN by a sampling pulse sequence to produce a sequence of sampled signals each of which is successively quantized into an input digital signal of a predetermined number of bits. The sampling pulse sequence is generated by a sampling pulse generator (not shown) in a well-known manner and is assumed to have a sampling frequency of 8 kHz, namely, a sampling period of 0.125 millisecond. In addition, the predetermined number may be equal, for example, to 12 bits.

At any rate, the input speech signal is sampled at every sampling period of 0.125 millisecond by the A/D converter 15 to be delivered as the input digital signal sequence to both a delay circuit 16 and a linear predictive coding (LPC) analysis circuit 17 both of which are operable in a manner to be described later in detail. Briefly, the LPC analysis circuit 17 serves to calculate LPC parameters.

On the other hand, it is to be noted that the A/D converter 15 and the delay circuit 16 form a part of a preliminary processing circuit 18 for preliminarily processing the input speech signal in a manner to be described later in detail.

In FIG. 1, the illustrated LPC analysis circuit 17 comprises a Hamming window circuit 21 for extracting a series of digital signals Ii from the digital signal sequence with reference to a Hamming window, namely, a temporal window having a time interval. The time interval may be assumed to be equal to 32 milliseconds in the illustrated example and may be called an analysis frame. In this connection, the illustrated analysis frame has a time interval of 32 milliseconds and may be discretely separated from the digital signal sequence with time. The analysis frame will be called an i-th analysis frame. To this end, the Hamming window circuit 21 is supplied with a frequency signal of 31.25 Hz from a frequency generator (not shown) to open the Hamming window of 32 milliseconds. Such a Hamming window circuit 21 can be implemented by known circuit elements in a known manner and will not therefore be described any longer. The digital signal series Ii within the analysis frame will be referred to as an analysis digital signal series.

In the LPC analysis circuit 17, the analysis digital signal sequence Ii is sent to a line spectrum pair (LSP) analyzer 22 which calculates a set of LSP parameters which may be recognized as one of the LPC parameters and which may be composed of first through tenth order parameters $\omega_1$ to $\omega_{10}$. Such LSP parameters can be obtained by carrying out an LPC analysis of the analysis digital signal series by the use of an autocorrelation method to at first produce $\alpha$ parameters and by further converting the $\alpha$ parameters into the LSP parameters.

The first through the tenth order parameters $\omega_1$ to $\omega_{10}$ are supplied to a LSP processor 23 to be quantized and decoded therein. Specifically, the LSP processor 23 processes the first through the tenth order parameters $\omega_1$ to $\omega_{10}$ to quantize each of the first through the fifth order parameters $\omega_1$ to $\omega_5$ into four bite and to further quantize each of the remaining parameters $\omega_6$ to $\omega_{10}$ into three bits. As a result, a whole of the first through the tenth order parameters $\omega_1$ to $\omega_{10}$ is represented by thirty-five (35) bite and is produced as a quantized LSP parameter of 35 bits. Furthermore, the LSP processor 23 locally decodes the quantized LSP parameter into a local decoded LSP parameter Pi which is accompanied by a quantization error. The local decoded LSP parameter Pi is delivered to an interpolator 24 which is operable in response to an interpolation timing signal having a frequency of 250 Hz sent from another frequency generator (not shown). From this fact, it is to be noted that the interpolator 24 interpolates the local decoded LSP parameter Pi at every time instant of four milliseconds to produce interpolated LSP parameters, although the local decoded LSP parameter Pi is produced only one time at every analysis frame.

Inasmuch as the analysis frame lasts for the time interval of 32 milliseconds, the local decoded LSP parameter Pi may be interpolated in the interpolator 24 eight times within every interpolation period of four milliseconds and is produced as a set of interpolated LSP parameters. If an i-th frame is selected as the analysis frame, the interpolated LSP parameters may be depicted at Pij where j takes an integer selected from −3, −2, −1, 0, 1, 2, 3, and 4, as will become clear. Herein, it may be considered that the interpolated LSP parameter Pi0 corresponds to a central one of the analysis digital signals Ii in the analysis frame.

Figure 3:
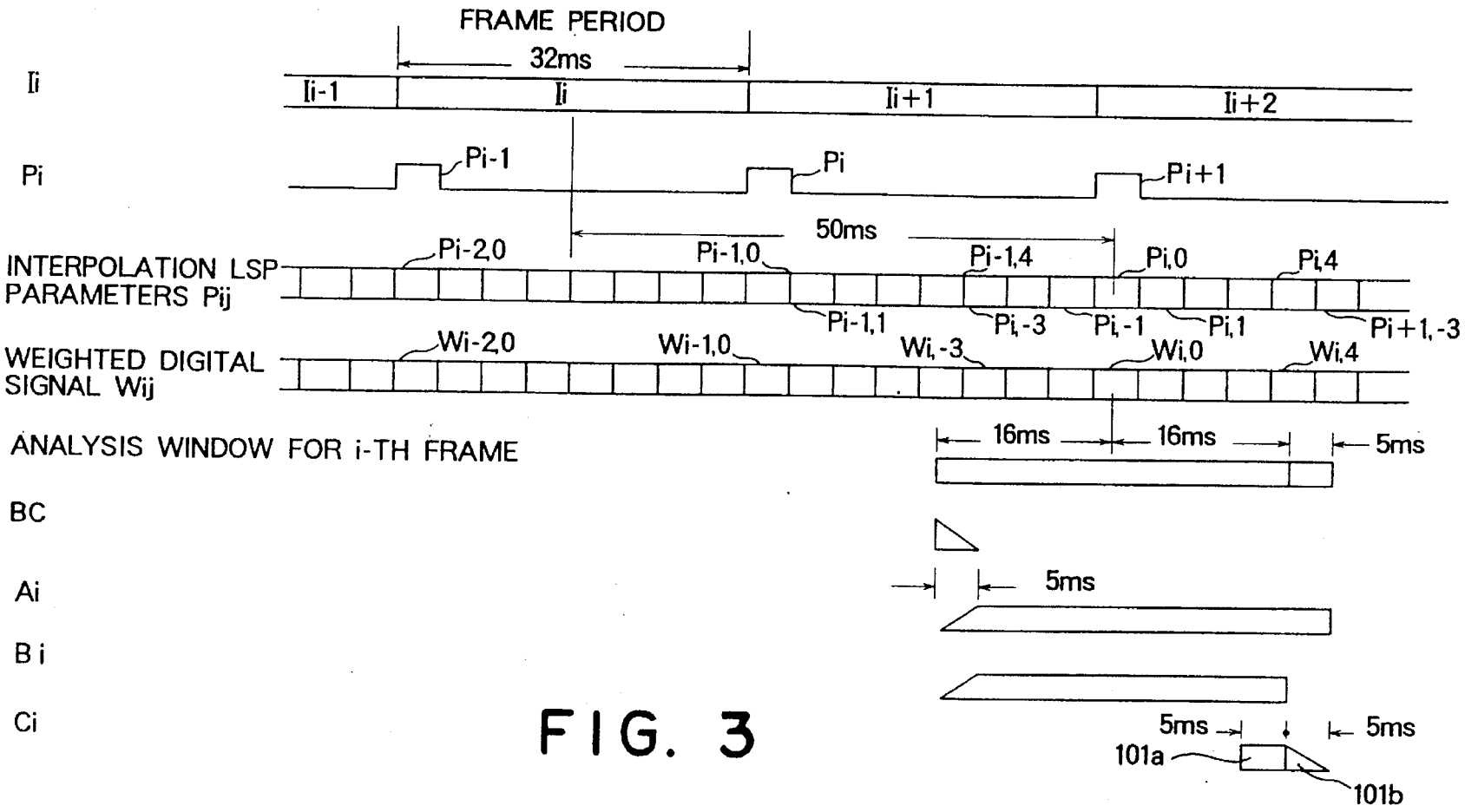
FIG. 3 is a time chart for use in describing operation of the speech signal analyzer illustrated in FIG. 1.

Temporarily referring to FIG. 3, the local decoded LSP parameter Pi for the i-th analysis frame is produced after lapse of the i-th analysis frame, as illustrated in FIG. 3. More specifically, the interpolated LSP parameter Pi0 appears simultaneously with the following local decoded LSP parameter Pi+1 calculated for the next frame period (i+1). This shows that each of the interpolated LSP parameters Pij for the i-th analysis frame is delayed by 50 milliseconds relative to each of the analysis digital Signals Ii for the i-th analysis frame, as represented by a relationship between the local decoded LSP parameter Pi and the central analysis digital signal both of which are illustrated in FIG. 3.

Referring back to FIG. 1, each of the interpolated LSP parameters Pij is composed of first through tenth order parameters and is sent to a parameter converter 25 to be converted into first through tenth order ones of $\alpha$ converted parameters that are depicted at $\alpha_k$ where k is an integer between 1 and 10. The converted $\alpha$ parameters $\alpha_k$ are given to an attenuation coefficient supplier 26 which serves to multiply the converted $\alpha$ parameters $\alpha_k$ by attenuation coefficients depicted at $\gamma^k$ and to produce those products of the attenuation coefficients and the converted $\alpha$ parameters $\alpha_k$ which are represented by $\alpha_k\gamma^k$, where $\gamma$ is greater than zero and smaller than unity. The products will be called attenuated parameters and are memorized into a first memory 27.

On the other hand, the attenuated parameters are sent together with the converted α parameters $\alpha_k$ to a spectrum modifier 31 which is included in the preliminary processing circuit 18.

As shown in FIG. 3, it is to be noted that the interpolated LSP parameters Pij are delayed by the time interval of 50 milliseconds relative to the analysis digital signal series Ii. In this connection, the analysis digital signal series Ii is delayed by 50 milliseconds by the delay circuit 16 and is sent as a delayed digital signal sequence to the spectrum modifier 31. As a result, the spectrum modifier 31 is supplied with the delayed digital signal sequence which is delayed by 50 milliseconds relative to the analysis digital signal series Ii.

The spectrum modifier 31 weights perceptual weights in a known manner in accordance with a filter characteristic which is defined by:

$$W(z)=\left(1-\sum_{k=1}^{10}\alpha_k z^{-k}\right)/\left(1-\sum_{k=1}^{10}\alpha_k\gamma^k z^{-k}\right). \quad (1)$$

The spectrum modifier 31 successively modifies the delayed digital signal sequence in accordance with Equation (1) to produce a sequence of weighted digital signals Wij in one-to-one correspondence to the interpolated LSP parameters Pij.

As a result, the weighted digital signals Wij are produced in synchronism with the interpolated LSP parameters Pij, as illustrated in FIG. 3.

In FIG. 1, the weighted digital signals Wij are sent to a window circuit 32 which defines an analysis window of 37 milliseconds in spite of the fact that a frequency signal of 31.25 Hz is given from a frequency generator (not shown). The analysis window of 37 milliseconds serves to separate the weighted digital signals WiJ for the i-th analysis frame. In this event, the weighted digital signals Wij separated by the window circuit 32 are represented by a series of the weighted digital signals Wi-3, Wi-2, Wi-1, Wi0, Wi1, Wi2, Wi3, and Wi4 each of which has a time interval of 4 milliseconds. Among others, a central one Wi0 of the above-mentioned weighted digital signals may be called a central weighted digital signal and appears at a central time instant of the weighted digital signals Wij.

As illustrated in FIG. 3, the analysis window for the i-th analysis frame has a previous part of 16 milliseconds prior to the central time instant, a following part of 16 milliseconds after the central time instant, and an additional park of 5 milliseconds succeeding the following part. This shows that the analysis window is longer than a time interval of the weighted digital signals Wij for the i-th analysis frame by five milliseconds.

In FIG. 1, the weighted digital signals Wij separated by the window circuit 32 are sent to a boundary compensator 33. The boundary compensator 33 is operable to compensate the weighted digital signals Wij at a boundary region of five milliseconds which is located in a preceding zone of the previous part of the i-th analysis frame. Such compensation is carried out in a manner to be described later in detail by the use of a boundary compensation signal BC which lasts for five milliseconds, as shown in FIG. 3, and which is produced in a manner to be described later. Anyway, the window circuit 32 produces a preliminary processed signal Ai as a result of preliminary processing of the i-th analysis frame. The preliminary processed signal Ai may be called a window processed signal because it is subjected to window processing in the window circuit 32 and the boundary compensator 33. Thus, the preliminary processed signal Ai is composed of a sequence of processed pulses having a constant amplitude and a constant phase and specifies an isolated analysis waveform. The preliminary processed signal may be called a sequence of processed digital signals and is supplied from the preliminary processing circuit 18 to a cross correlation circuit 36 which comprises a cross correlation calculator 37 and a second memory 38. Each of the processed pulses appears at a pulse period equal to the input digital signals sent from the A/D converter 15 and therefore has the pulse period of 0.125 milliseconds.

Herein, it is to be noted that the preliminary processed signal Ai has a time interval longer than the i-th frame period by five milliseconds, as mentioned before, and therefore has a trailing edge placed five milliseconds after completion of the i-th analysis frame. This shows that the above-mentioned pulse analysis is made with reference not only to the weighted digital signals Wij but also to a part of weighted digital signals An the following frame and enables environmental compensation of a portion close to the trailing edge of the weighted digital signal series Wij.

In addition, inasmuch as the preliminary processed signal Ai lasts for 37 milliseconds while the processed pulses in the preliminary processed signal Ai appears at the pulse period of 0.125 millisecond, the time interval of the preliminary processed signal Ai is composed of the processed pulses which are equal in number to 296 and which are arranged in zeroth through 295-th time slots $t_0$ to $t_{295}$, respectively.

Referring back to FIG. 1, the illustrated cross correlation calculator 37 is connected to an impulse response circuit 41 which comprises an impulse response calculator 42 and a third memory 43. Specifically, the impulse response calculator 42 is connected to the first memory 27 which is loaded with the attenuated parameters, namely, the attenuated α parameters from the attenuation coefficient supplier 26. The impulse response calculator 42 defines an all-pole filter which is given by:

$$H(z)=1/\left(1-\sum_{k=1}^{10}\alpha_k\gamma^k z^{-1}\right). \quad (2)$$

In the example being illustrated, impulse responses are calculated on the basis of Equation (2) in relation to all of the zeroth through 295-th time slots and may be represented by $U_v^0$, $U_v^1$, . . . , $U_v^{295}$, respectively, where v is variable between 0 and 39. This shows that each of the impulse responses has a response time interval which is equal to forty samples, namely, 5 milliseconds because each sample appears at every period of 0.125 millisecond. In other words, each impulse response is calculated only within a duration of five milliseconds. This is because each of the impulse responses is sufficiently converged into zero after lapse of five milliseconds or so.

Since each attenuated α parameter $\alpha_k\gamma^k$ is renewed at every time interval of four milliseconds even during calculation of each impulse response, as mentioned before, the all-pole filter defined by Equation (2) may be called a time variant filter. Although the term "impulse response" may be generally defined only about a time invariant filter, the meaning of the term "impulse response" is expanded to a time variant filter in the instant specification, as mentioned before. At any rate, the impulse responses calculated in the above-mentioned manner are memorized in the third memory 43.

From the above, it is readily understood that the cross correlation calculator 37 is given the preliminary processed signal Ai and each of the impulse responses $U_v^0, U_v^1, \ldots, U_v^{295}$ memorized in the third memory 43. Under the circumstances, the cross correlation calculator 36 calculates a sequence of cross correlation coefficients ø(q) between the preliminary processed signal Ai and the impulse responses $U_v^0, U_v^1, \ldots, U_v^{295}$ in accordance with the following equation (3):

$$\phi(q) = \sum_{v=0}^{39} A_{q+v} U_v^q, \tag{3}$$

where q is variable between 0 and 295, both inclusive.

On the other hand, the impulse responses $U_v^0, U_v^1, \ldots, U_v^{295}$ are also sent to an autocorrelation circuit 46 which comprises an autocorrelation calculator 47 and a fourth memory 48.

Supplied with the impulse responses $U_v^0, U_v^1, \ldots, U_v^{295}$, the autocorrelation calculator 47 calculates a sequence of autocorrelation coefficients $\rho_r^q$ which are given by:

$$\rho_r^q = \sum_{v=-39}^{39} U_v^q U_{v+r}^q \tag{4}$$

From Equation (4), it is readily understood that the autocorrelation coefficients $\rho_r^q$ calculated are equal in number to 296 and each of the autocorrelation coefficients $\rho_r^q$ is calculated with reference to 79 samples and is memorized in the fourth memory 48. In any event, the autocorrelation coefficients $\rho_r^q$ are calculated within the analysis frame, namely, the i-th analysis frame.

The autocorrelation coefficients $\rho_r^q$ and the cross correlation coefficients ø(q) are read out of the second and the fourth memories 38 and 48 to be sent to a maximum similarity series searching circuit 50.

Briefly, the maximum similarity series searching circuit 50 searches for a sequence of excitation pulses Bi for the i-th analysis frame (namely, the time interval of 32 milliseconds) from the leading edge of the preliminary processed signal Ai by the use of the autocorrelation coefficients $\rho_r^q$ and the cross correlation coefficients ø(q). The excitation pulses Bi are representative of an exciting source and may be referred to as exciting source information. In this event, such a searching operation is based on conditions that the excitation pulses Bi are composed of an equidistant time interval and an identical amplitude and are variable in phase and in polarity of each pulse.

Figure 4:
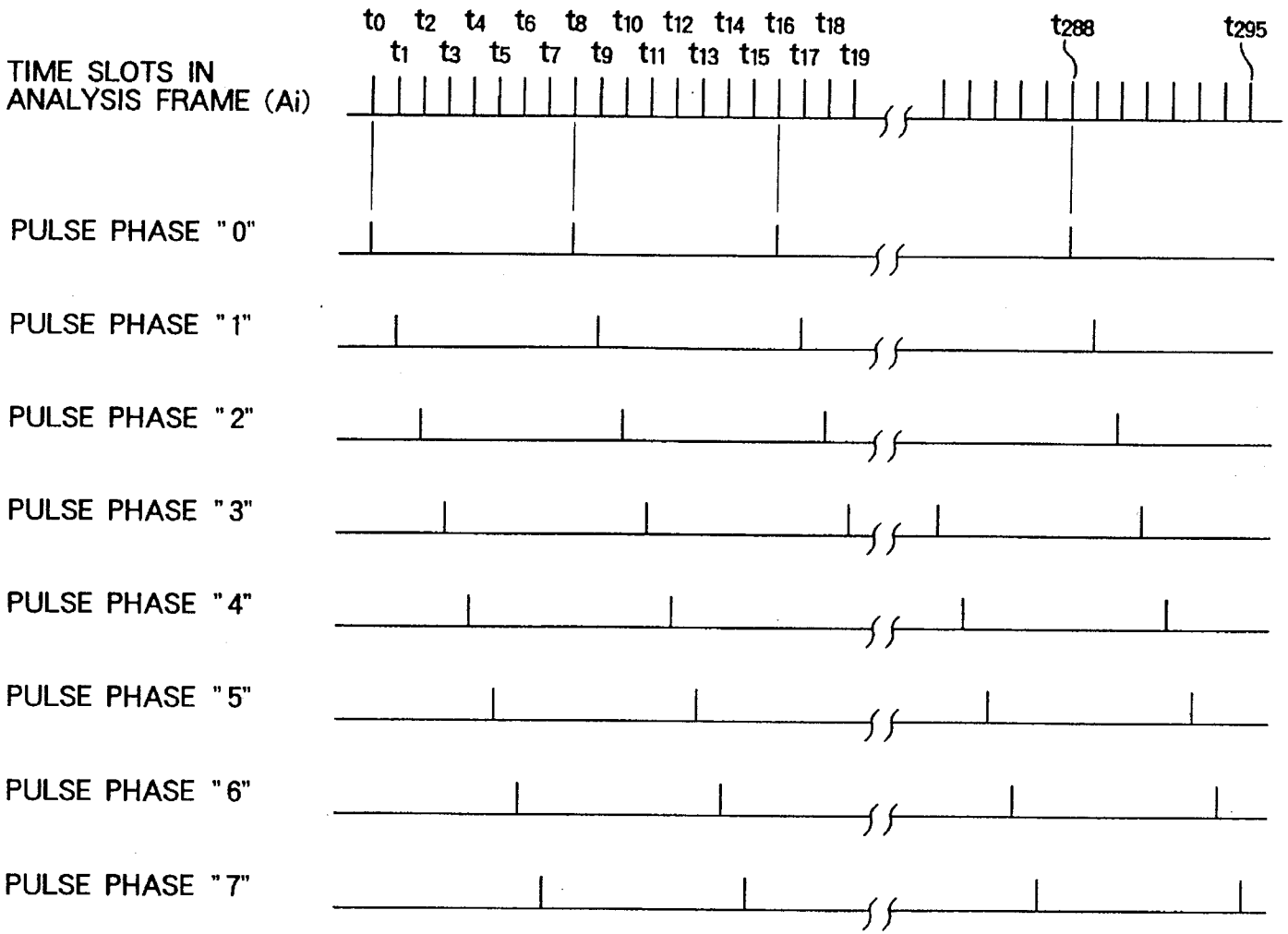
FIG. 4 is a time chart for describing pulse sequences of zeroth through seventh phases used in the speech signal analyzer illustrated in FIG. 1.

Referring to FIG. 4 together with FIG. 1, the maximum similarity series searching circuit 50 will be described more in detail. The maximum similarity series searching circuit 50 is operated in the i-th analysis frame in accordance with zeroth through seventh pulse sequences which have zeroth through seventh pulse phases "0" to "7", respectively, as illustrated in FIG. 4. In this connection, it is readily understood that the zeroth pulse sequence of the zeroth phase "0" appears at the zeroth, the eighth, . . . , and the 288-th time slots t0, t8, . . . , t288 and the first pulse sequence of the first phase "1" appears at the first, the ninth, . . . , the 289-th time slots t1, t9, . . . , t289. Likewise, the seventh pulse sequence appear at the seventh, the fifteenth, . . . , and the 295-th time slots t7, t15, . . . , t295 within the i-th analysis frame. Thus, each of the zeroth through the seventh pulse sequences is produced at a time slot period of eight time slots, as illustrated in FIG. 4.

Figure 5:
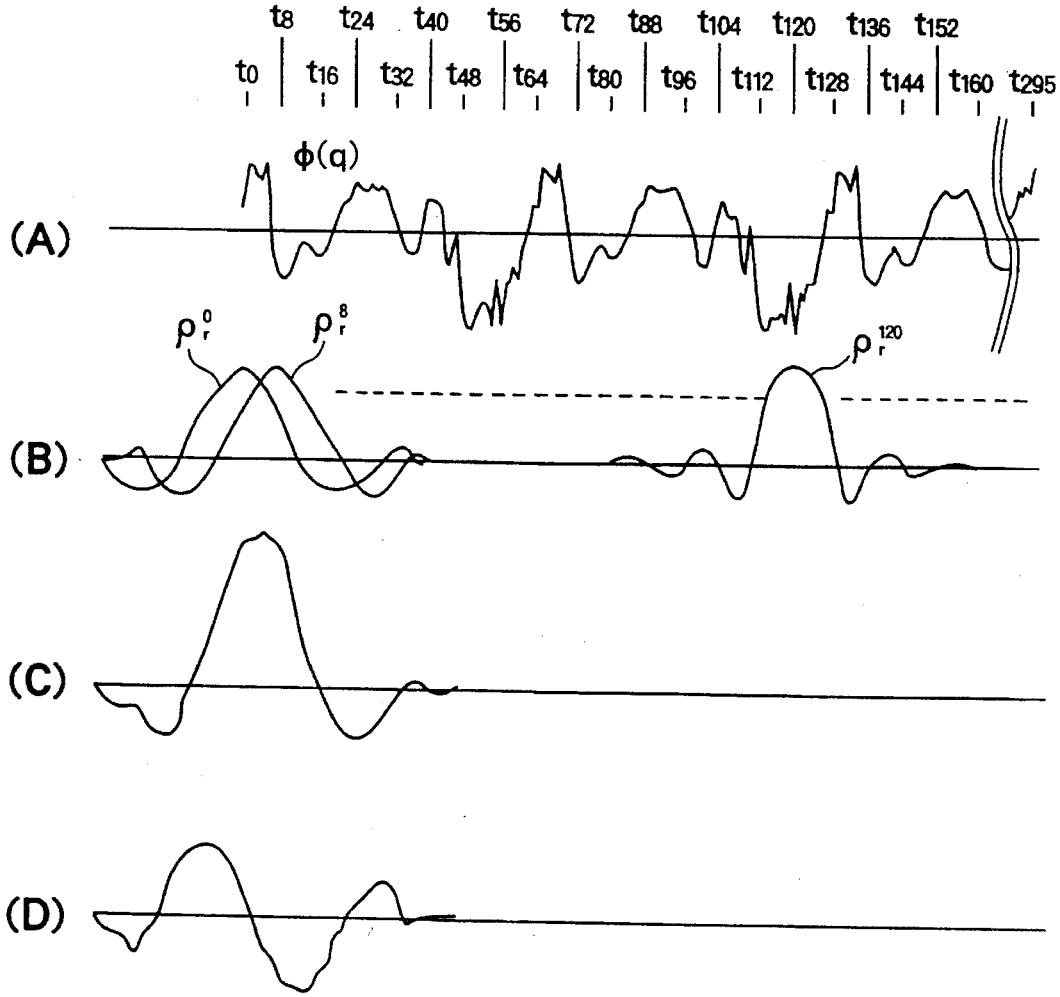
FIG. 5 shows waveforms for use in describing operation of a part of the speech signal analyzer illustrated in FIG. 1.

Referring to FIG. 5 in addition to FIG. 1, the maximum similarity series searching circuit 50 is supplied with the cross correlation coefficients ø(q) and the autocorrelation coefficients $\rho_r^q$ from the second and the fourth memories 38 and 48, as illustrated in FIGS. 5(A) and (B), respectively. In FIG. 5(A), the cross correlation coefficients ø(q) are shown over the zeroth through the 295-th time slots in the illustrated frame. On the other hand, only three series of the autocorrelation coefficients $\rho_r^0$, $\rho_r^8$, and $\rho_r^{120}$ are illustrated in FIG. 5(B). It is to be noted that each of the autocorrelation coefficient series $\rho_r^0$, $\rho_r^8$, and $\rho_r^{120}$ is produced at the zeroth, the eighth, and the 120-th time slots as a result of varying the term r between −39 and 39, both inclusive.

As understood from Equation (4), the autocorrelation coefficients $\rho^q$ are calculated in a range arranged between the sample of −39 and the sample of 39 with each sample sampled at the sample period of 0.125 millisecond.

In the illustrated example, the maximum similarity series searching circuit 50 sums up the autocorrelation coefficients $\rho_r^q$ at every time slot (q) to detect similarities, as will become clear later in detail. Herein, the autocorrelation coefficients $\rho_r^q$ between the zeroth and the seventh time slots t0 and t7 may be considered in relation to $\rho_r^0, \rho_r^1, \ldots, \rho_r^{45}$ where r is variable between −39 and 39.

When attention is directed to the zeroth phase "0", consideration may be made within the time duration between t0 and t7 as regards $\rho_r^0$, $\rho_r^8$, $\rho_r^{16}$, $\rho_r^{24}$, $\rho_r^{32}$, and $\rho_r^{40}$ with r being variable between −39 and 39.

The zeroth pulse sequence of the zeroth phase "0" is composed of thirty-two pulses arranged in the zeroth, the eighth, . . . , the 248-th time slots. Under the circumstances, the maximum similarity series searching circuit 50 determines each polarity of the thirty-two pulses having the zeroth phase "0". At first, consideration is made about all combinations of polarities arranged in the zeroth, the eighth, the sixteenth, the twenty-fourth, the thirty-second, and the fortieth time slots t0, t8, t16, t24, t32, and t40. Such combinations are equal in number to 64 in total. To this end, the autocorrelation coefficients in the above-mentioned time slots are added to one another in consideration of the polarity of each autocorrelation coefficient to obtain sixty-four series of the autocorrelation coefficients and to consequently specify a waveform in consideration of a polarity of each pulse.

Thereafter, the maximum similarity series searching circuit 50 measures the similarities between a waveform specified by the cross correlation coefficients and each waveform specified by the sixty-four series of the autocorrelation coefficients and selects a maximum one of the similarities, namely, a maximum degree of the similarities. Such measurement of the above-mentioned similarities can be carried out by calculating initial cross correlations between the cross correlation coefficients ø(q) and each series of the autocorrelation coefficients ρ in the above-mentioned time slots for a time interval defined by the zeroth through the seventh time slots t0 to t7. Herein, it is assumed that the initial cross correlations among the zeroth through the seventh time slots are depicted at ψ(7) and a maximum one of the initial cross correlations is selected by the maximum similarity series searching circuit 50. In this event, the maximum one of the initial cross correlations is considered as representing the maximum similarity between the above-mentioned waveforms. The procedure mentioned before can be specified by:

$$\psi(7)=\max\begin{cases}\sum_{q=0}^{7}\phi(q)[+\rho_q^0+\rho_{q-8}^8+\rho_{q-16}^{16}+\rho_{q-24}^{24}+\rho_{q-32}^{32}+\rho_{q-40}^{40}]\\ \sum_{q=0}^{7}\phi(q)[+\rho_q^0+\rho_{q-8}^8+\rho_{q-16}^{16}+\rho_{q-24}^{24}+\rho_{q-32}^{32}-\rho_{q-40}^{40}]\\ \sum_{q=0}^{7}\phi(q)[+\rho_q^0+\rho_{q-8}^8+\rho_{q-16}^{16}+\rho_{q-24}^{24}-\rho_{q-32}^{32}+\rho_{q-40}^{40}]\\ \cdot\\ \cdot\\ \cdot\\ \sum_{q=0}^{7}\phi(q)[-\rho_q^0-\rho_{q-8}^8-\rho_{q-16}^{16}-\rho_{q-24}^{24}-\rho_{q-32}^{32}-\rho_{q-40}^{40}]\end{cases}\quad(5)$$

By the use of Equation (5), selection is made in the maximum similarity series searching circuit 50 about one of the sixty-four autocorrelation coefficient series that is included in the maximum one of the initial cross correlations. Subsequently, decision is made about a polarity of a zeroth pulse arranged in the zeroth time slot t0o on the basis of a result of summation of the one of the sixty-four autocorrelation coefficient series. The decided polarity will be represented by sgn(0).

Next, further consideration is directed to combinations of polarities of pulses arranged in the following six time slots, namely, the eighth, the sixteenth, the twenty-fourth, the thirty-second, the fortieth, and the forty-eighth time slots t8, t16, t24, t32, t40, and t48 in addition to the zeroth pulse arranged in the zeroth time slot t0. Such combinations of the polarities are equal in number to sixty-four.

For this purpose, the sixty-four autocorrelation coefficient series are formed to specify waveforms in consideration of a polarity of each pulse and are represented by series of additions like in Equation (5). In this event, each autocorrelation coefficient series is represented by an addition of the above-mentioned six time slots and a product of the autocorrelation coefficient $\rho_q^0$ and the zeroth pulse having a determined polarity (sgn(0)). Subsequently, similarities of waveforms are measured between the cross correlation coefficients ø(15) and the respective sixty-four autocorrelation coefficient series to detect a maximum one of the similarities. Like in Equation (5), cross correlations ψ are calculated between the cross correlation coefficients and the respective sixty-four autocorrelation coefficient series. A maximum one of the cross correlations ψ(15) is selected in accordance with Equation (6) given by;

(sgn(16)) of a pulse arranged in the sixteenth time slot t16 is determined with the polarities of pulses fixed in the zeroth and the eighth time slots t0 and t8 and with polarities of pulses voluntarily determined in a plus sign or minus sign in connection with the pulses located in the sixteenth, the twenty-fourth, the thirty-second, the fortieth, the forty-eighth, and the fifty-sixth time slots t16, t24, t32, t40, t48, and t56.

Similar procedure is continued until a polarity (sgn(248)) of a pulse in the 248-th time slot t248 is determined by the maximum similarity series searching circuit 50. At any rate, the polarities of the pulses in the zeroth phase are given by the above-mentioned procedure from the zeroth time slot t0 to the 248-th time slot t248. In other words, the polarities of the thirty-two pulses are determined in conjunction with the pulse sequence of the zeroth phase in the above-mentioned manner.

The above procedure is applied to each pulse sequence which has the first through the seventh phases. As a result, decision is made about the polarities of the pulses which are arranged in the respective time slots assigned to the first through the seventh phases "1" to "7".

Subsequently, autocorrelation coefficients are further calculated as regards the pulse sequences that have the zeroth through the seventh phases and the polarities decided and that may be referred to as zeroth through seventh pulse sequences each of which is composed of thirty-two pulses, as mentioned before. The autocorrelation coefficient series for each of the zeroth through the seventh pulse sequences are compared to the cross correlation coefficient series to measure similarities between waveforms specified by the autocorrelation coefficient series and the cross correlation series. As a result of measurement, selection is made as regards one of the zeroth through the seventh pulse sequences that has a maximum similarity and that is specified by a selected one of the zeroth through the seventh phases "0" to "7". Such a selected pulse sequence is produced as the excitation pulse sequence Bi from the maximum similarity series searching circuit 50 together with a phase signal representative of the selected phase, as illustrated in FIG. 3.

From this fact, it is to be noted that each pulse of the selected pulse sequence appears only one at each of the eight time slots. In other words, the selected pulse sequence produced within the 256 time slots are equal in number to thirty-two. On the other hand, the selected phase can be $$\psi(15)=\max\begin{cases}\sum_{q=0}^{15}\phi(q)[sgn(0)\rho_q^0+\rho_{q-8}^8+\rho_{q-16}^{16}+\rho_{q-24}^{24}+\rho_{q-32}^{32}+\rho_{q-40}^{40}+\rho_{q-48}^{48}]\\ \sum_{q=0}^{15}\phi(q)[sgn(0)\rho_q^0+\rho_{q-8}^8+\rho_{q-16}^{16}+\rho_{q-24}^{24}+\rho_{q-32}^{32}+\rho_{q-40}^{40}-\rho_{q-48}^{48}]\\ \cdot\\ \cdot\\ \cdot\\ \sum_{q=0}^{15}\phi(q)[sgn(0)\rho_q^0-\rho_{q-8}^8-\rho_{q-16}^{16}-\rho_{q-24}^{24}-\rho_{q-32}^{32}-\rho_{q-40}^{40}-\rho_{q-48}^{48}]\end{cases}\quad(6)$$

Thereafter, one of the sixty-four autocorrelation coefficient series is extracted from the maximum one of the cross correlations ψ(15) to determine only a polarity of a pulse which is located in the eighth time slot t8 and which is depicted at sgn(8).

Thus, the polarities of the pulses in the zeroth and the eighth time slots are determined and fixed by the maximum similarity series searching circuit 50. Furthermore, a polarity represented by three bits so as to specify the zeroth through the seventh phases and the phase signal may have three bits.

In any event, the selected pulse sequence, namely, the excitation pulse sequence Bi are sent together with the phase signal to an amplitude calculator 51, a multiplexer 52, and an LPC synthesizer filter 53, as illustrated in FIG. 1.

Referring back to FIG. 1, the excitation pulses Bi of 32 bits and the phase signal of 3 bits are delivered to the multiplexer 52, the amplitude calculator 51, and the LPC synthesizer filter 53.

In this event, the amplitude calculator 51 obtains a synthesized waveform from the excitation pulse sequence Bi sent from the maximum similarity series searching circuit 50. In the illustrated example, the amplitude calculator 51 cannot carry out any filter calculation but calculates the synthesized waveform by adding impulse responses memorized in the third memory 43. Subsequently, the amplitude calculator 51 determines a pulse amplitude by comparing the synthesized waveform with the pulse analysis waveform Ai. Specifically, the pulse amplitude is determined by selecting a pulse amplitude which gives a maximum similarity between the synthesized waveform and the pulse analysis waveform Ai in electric power of a whole frame. Such decision of the pulse amplitude can be made by calculating a minimum amplitude A which minimizes P given by Equation (7):

$$P=\sum_{l=0}^{255}(w_l-Ax_l)^2, \tag{7}$$

where $w_l$ represents a sample value in a time slot t1 of the pulse analysis waveform Ai and $x_l$ represents a sample value in a time slot t1 of the synthesized waveform on the assumption that energy becomes equal to 1.

From Equation (7), it is understood that the pulse amplitude A is given by:

$$A=\left(\sum_{l=0}^{255}w_l\right)/\left(\sum_{l=0}^{255}x_l\right). \tag{8}$$

The pulse amplitude A calculated by the amplitude calculator 51 is sent to a quantization decoder 56 to be quantized into a quantized amplitude signal of six bits which is delivered to the multiplexer 52 on one hand and to the LPC synthesizer filter 53 on the other hand.

Figure 6:
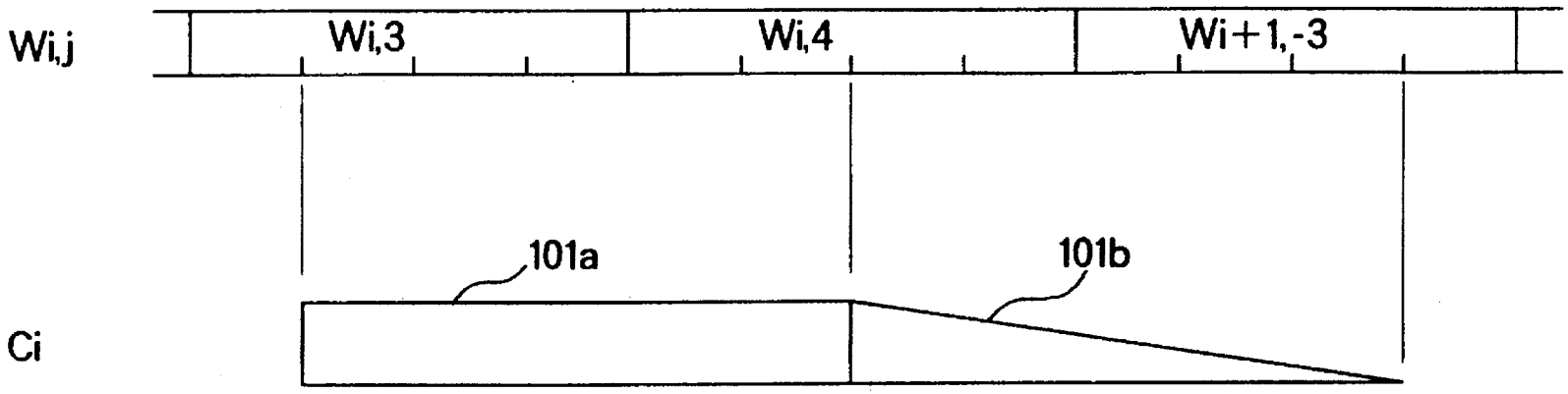
FIG. 6 shows a time chart which enlarges a portion of the time chart illustrated in FIG. 3.

The LPC synthesizer filter 53 is supplied from the first memory 27 with the α parameters multiplied by the attenuation coefficients (γ) for the i-th frame. In addition, the LPC synthesizer filter 53 is also supplied from the maximum similarity series searching circuit 50 with a pulse sequence which represents a pulse amplitude for a time duration of 5 milliseconds after the i-th frame of 32 milliseconds and which specifies the pulse amplitude calculated by the amplitude calculator 51. Under the circumstances, the LPC synthesizer filter 53 produces, as the control signal Ci, a filter output signal as illustrated in FIGS. 3 and 6. As illustrated in FIGS. 3 and 6, the control signal Ci has a leading half portion 101*a* of 5 milliseconds and a trailing half portion 101*b* of 5 milliseconds. The leading half portion 101*a* is operable as a pulse excitation portion while the trailing half portion 101*b* is operable as an oscillation attenuating portion. The pules excitation portion reproduces a signal portion for a time interval which begins at a time instant of 27 milliseconds in the window of the i-th frame and which lasts at a time instant of 32 milliseconds. In other words, the pulse excitation portion corresponds to a reproduction signal of the weighted digital signal which is located for 5 milliseconds immediately before (i+1)-th frame specified by the window of 37 milliseconds.

It is to be noted that the leading portion of the window of 37 milliseconds in the i-th frame is influenced by a preceding portion which may be the oscillation attenuated portion of an (i−1)-th frame.

The boundary compensator 33 serves to compensate for the leading portion of the i-th frame by subtracting, from the weighted digital signals for the i-th frame, the oscillation attenuation portion 101*b* of five milliseconds for the (i−1)-th frame. In other words, the boundary compensation signal Ci-1 (FIGS. 3 and 6) of 5 milliseconds calculated for (i−1)-th frame is subtracted from the window output signal of the 37 milliseconds. At any rate, the boundary compensation is carried out during the leading portion of the i-th frame to obtain the pulse analysis waveform Ai.

The multiplexer 52 is supplied with the quantized LSP parameters of 35 bits, the pulse phase signal of 3 bits, and the pulse polarity signal of 32 bits, and the pulse amplitude signal of 6 bits at every frame period of 32 milliseconds. Herein, the quantized LSP parameters, the pulse phase signal, the pulse polarity signal, and the pulse amplitude signal are sent to the multiplexer 52 from the LSP quantization decoder 52, the maximum similarity series searching circuit 50, and the amplitude quantization decoder 56, as mentioned before.

A total bit number of the above-mentioned signals becomes equal to seventy-six (76) bits. In this example, a frame period bit is added to 76 bits at a rate of four bits per five frames, namely, at a rate of 0.8 bit per a single frame. As a result, a transmission frame has an average bit rate of 76.8 bits. At any rate, a transmission date signal is sent from the analyzer 10 to the synthesizer 11 at an output bit rate which is equal to 76.8 bits/0.032, namely, 2400 bits/second.

In order to facilitate an understanding, the maximum similarity series searching circuit 50 will be described with reference to FIG. 7 more in detail.

Figure 7:
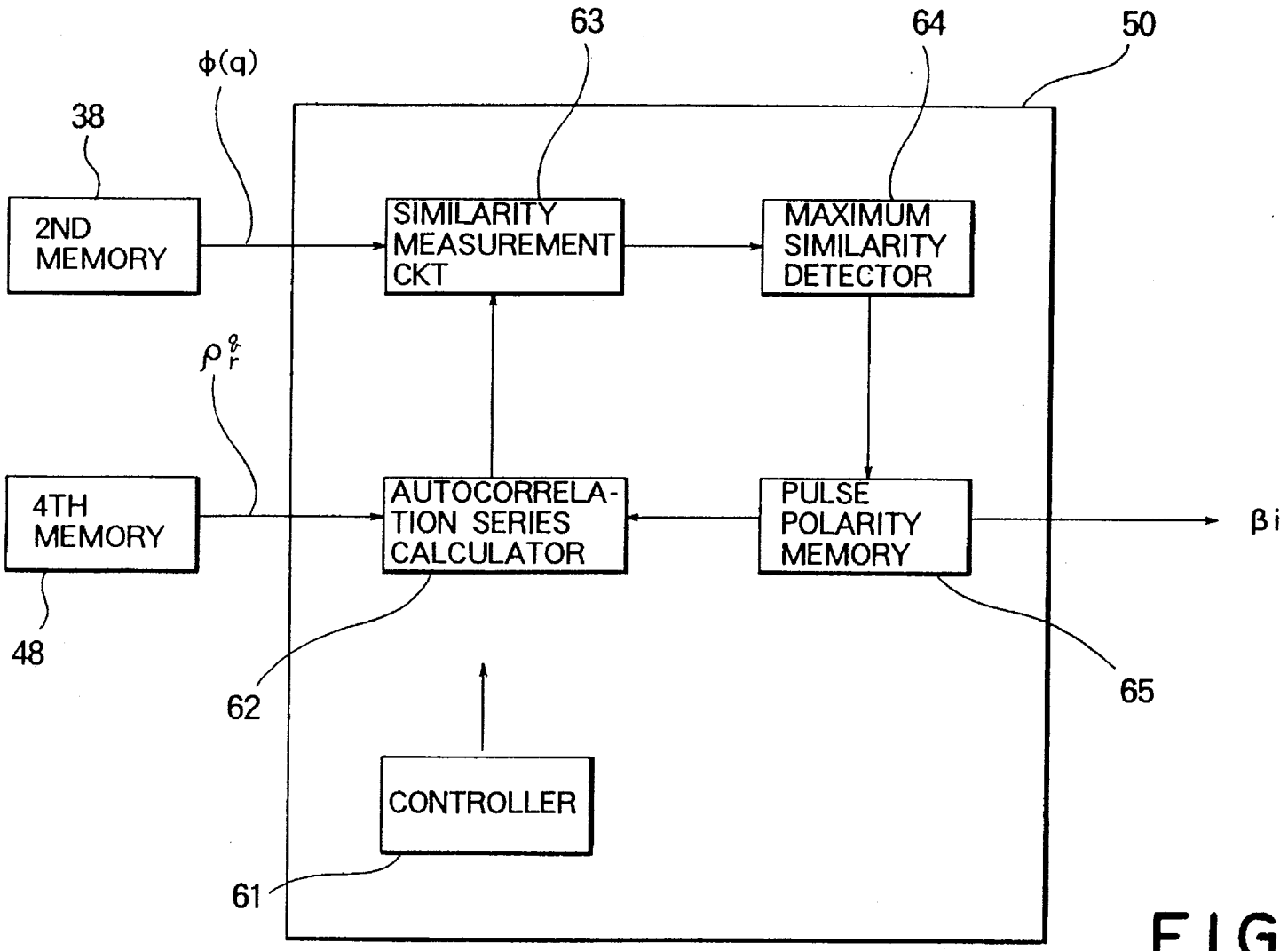
FIG. 7 is a block diagram of a maximum similarity series searching circuit illustrated in FIG. 1.

In FIG. 7, the maximum similarity series searching circuit 50 comprises a controller 61, an autocorrelation series calculator 62, a similarity measurement circuit 63, a maximum similarity detector 64, and a pulse polarity memory 65. The controller 61 is operable in accordance with a predetermined program to process operation of the illustrated circuit 50 and may be a microprocessor. The controller 61 controls all of the remaining elements, as mentioned above, in a manner to be described later.

In FIG. 7, the autocorrelation series calculator 62 is coupled to the fourth memory 48 to calculate the autocorrelation coefficient series in the above-mentioned manner. More particularly, the autocorrelation series calculator 62 serves to calculate the autocorrelation coefficient series mentioned in the second terms on the righthand side of Equation (5). To this end, the autocorrelation series calculator 62 comprises a random access memory which has a predetermined memory capacity and which is used for successively memorizing the autocorrelation coefficients which are described in Equation (5). The random access memory should memorize the autocorrelation coefficients depicted at $\rho_{t1}^{0}$, $-\rho_{t1}^{0}$, $\rho_{t1-8}^{8}$, $-\rho_{t1-8}^{8}$, $\rho_{t1-16}^{16}$, $-\rho_{t1-16}^{16}$, $\rho_{t1-24}^{24}$, $-\rho_{t1-24}^{24}$, $\rho_{t1-32}^{32}$, $-\rho_{t1-32}^{32}$, $\rho_{t1-40}^{40}$, $-\rho_{t1-40}^{40}$ where t1 is variable between 0 and 7, both inclusive. Herein, the autocorrelation coefficient $\rho_{t1-40}^{40}$ is equal to 40 $\rho_{-40}^{40}$ and is located outside of a defined range. In this connection, the autocorrelation coefficient $\rho_{t1-40}^{40}$ may be evaluated as zero and may not be memorized in the random access memory.

The above-mentioned autocorrelation coefficients are memorized in the following manner.

At first, the random access memory included in the autocorrelation series calculator 62 has a plurality of columns equal in number to 64 and a plurality of rows equal in number to 256. Each column is specified by an s-address, namely, a column address while each row is specified by a t-address, namely, a row address. In this connection, the s-address can be changed between a first column address and a sixty-fourth column address while the t-address can be changed between a first row address and a 256-th row address.

Under the circumstances, the autocorrelation coefficients $\rho_r^0$ are successively read out of the third memory 43 to be memorized into the random access memory where r is variable between −39 and 39. In this event, the autocorrelation coefficients $\rho_{t1}^0$ are memorized in the column and the row addresses represented by (s, t1+1) where t1 is variable between 0 and 7, both inclusive and s is variable between 1 and 32. More particularly, the first through the thirty-second column addresses "1" to "32" arranged along the first row address "1" are loaded with the autocorrelation coefficient $\rho_0^0$. Likewise, the first through the thirty-second column addresses arranged along the eighth row address are loaded with the autocorrelation coefficient $\rho_7^0$.

On the other hand, the thirty-third through the sixth-fourth column addresses along the first through the eighth row addresses are loaded with $-\rho_{t1}^0$ where t1 is variable between 0 and 7. Specifically, the thirty-third through the sixty-fourth column addresses along the first row address are loaded with the autocorrelation coefficient $-\rho_0^0$. At any rate the autocorrelation coefficients $-\rho_{t1}^0$ are memorized in the column and the row addresses represented by (s, t1+1) where s is variable between 33 and 64, both inclusive, and t1 is variable between 0 and 7, both inclusive.

Next, the autocorrelation coefficients specified by $\rho_r^8$ are also memorized in a manner similar to that mentioned above, where r is variable between −39 and 39, both inclusive. In this case, the autocorrelation coefficients $\rho_{t1-8}^8$ are memorized in the column and the row addressee specified by (s+u, t1+1), where t1 is variable between 0 and 7; s is variable between 1 and 16; and u takes either 0 or 32. For example, the first through the sixteenth column addresses arranged along the first row address are loaded with the autocorrelation coefficient $\rho_{-7}^8$ while the first through the sixteenth column addresses along the second row address are loaded with the autocorrelation coefficient $\rho_{-7}^8$. Likewise, the first through the sixteenth column addresses along the eighth row address are loaded with $\rho_{-1}^8$.

From this fact, it is to be noted that the sum results of the autocorrelation coefficients $\rho_{t1}^0$ and $\rho_{t1-8}^8$ are memorized in the column and the row addressses (s+u, t1+1).

In a like manner, the autocorrelation coefficients $-\rho_{t1-8}^8$ are also memorized in the column and the row addresses specified by (s+u, t1+1), where t1 is variable between 0 and 7, both inclusive; s is variable between 17 and 32; and u takes either 0 or 32. This means that sum results of the autocorrelation coefficients $-\rho_{t1-8}^8$ and the autocorrelation coefficients $\rho_{t1}^0$ are memorized in the column and the row addresses specified by (s+u, t1+1).

Furthermore, sum results of the autocorrelation coefficients $\rho_{t1-16}^{16}$ are memorized in the column and the row addresses which are represented by (s+u, t1+1), where t1 is variable between 0 and 7, both inclusive; s is variable between 1 and 8, both inclusive; and u takes either one of 0, 16, 32, and 48 while sum results of the autocorrelation coefficients $-\rho_{t1-16}^{16}$ are memorized in the column and the row addresses represented by (s+u, t1+1), where t1 is variable between 0 and 7, both inclusive; s is variable between 9 and 16, both inclusive; and u takes either one of 0, 16, 32, and 48.

Thereafter, the autocorrelation coefficients $\rho_{t1-24}^{24}$ and $\rho_{t1-32}^{32}$ are successively added to obtain sum results in accordance with Equation (5) and the sum results are memorized in column and row addresses determined in a manner similar to that mentioned above where t1 is variable between 0 and 7. The autocorrelation coefficients $\rho_{t1-40}^{40}$ and $-\rho_{t1-40}^{40}$ are summed up and memorized in the column and the row addresses specified by (s, t1+1) where t1 is variable between 1 and 7; s takes either one of 1, 3, 5, . . . , 63 while the autocorrelation coefficients $-\rho_{t1-40}^{40}$ are summed up and memorized in the column and the row addresses (s, t1+1) where t1 is variable between 1 and 7; s takes either one of 2, 4, 6, . . . , 64. However, it is noted that the autocorrelation coefficient $\rho_{-40}^{40}$ are located outside of a defined region for the autocorrelation coefficients and may be handled as zero. As a result, the autocorrelation coefficient $\rho_{-40}^{40}$ are not summed up in the illustrated example.

In the autocorrelation series calculator 62, the autocorrelation coefficients are successively read out of the random access memory under control of the controller 61 to form the autocorrelation coefficient series which appear on the right-hand side of Equation (5). Each of the autocorrelation coefficient series is sent to an adder circuit which is included in the autocorrelation series calculator 62 and which sums up each autocorrelation coefficient series to successively produce a sum signal which is representative of a sum of each autocorrelation coefficient series and which is equal in number to sixty-four. Each sum signal specifies a waveform based on each of the autocorrelation coefficient series.

The sum signals are sent to the similarity measurement circuit 63 which is supplied from the second memory 38 with the cross correlation coefficients ø(q) where q is variable between 0 and 7, both inclusive. The similarity measurement circuit 63 carries out calculations defined on the righthand side of Equation (5) to obtain calculation results which correspond to the similarities between the waveforms specified by the cross correlation coefficients ø(q) and each of the autocorrelation coefficient series. Such calculations may be made by convoluting the cross correlation coefficients and each of the autocorrelation coefficient series in the manner mentioned Equation (5). Thereafter, the calculation results are produced from the similarity measurement circuit 63 in the form of calculation result signals and are representative of correlations (ψ) between the cross correlation coefficients and each of the autocorrelation coefficients ø(q). The calculation result signals are equal in number to sixty-four and are obtained by carrying out sixty-four calculations which are represented by the righthand sides of Equation (5) and which are divided into a former half of sixty-four calculations and a latter half of sixty-four calculations. It is mentioned here that the former half exhibits a positive value while the latter half takes a negative value.

The calculation result signals of 64 in number are successively sent to the maximum similarity detector 64 to select the maximum one of the similarities. The maximum similarity detector 64 produces, as a maximum similarity detection signal, +1 and −1 and supplies the maximum similarity detection signal to the pulse polarity memory 65 when the maximum similarity is detected within a former half of the sixty-four calculation result signals and a latter half thereof, respectively. It is to be understood that the maximum similarity detection signal is representative of the polarity of the autocorrelation coefficient series which exhibits the maximum similarity. In this connection, the maximum similarity detection signal may be called a polarity signal.

The pulse polarity memory 65 is implemented by a random access memory which has eight rows and thirty-two columns specified by a dimension (8, 32). This shows that the pulse polarity memory 65 can be accessed by the use of two dimensional addresses given from the controller 61. At any rate, the maximum similarity detection signal, namely, the polarity signal is memorized into an address (1, 1) of the pulse polarity memory 65.

The polarity signal is read out of the address (1, 1) under control of the controller 61 and is given to the autocorrelation series calculator 62 in the form of sgn(0).

If the polarity signal sgn(0) takes +1, the autocorrelation series calculator 62 makes the random access memory write the autocorrelation coefficients $\rho_{t1}^{0}$ into the addresses specified by (s, t1+1) where t1 is variable between 0 and 15 and s is variable between 1 and 64. On the other hand, if the polarity signal sgn(0) takes −1, the random access memory memorizes $-\rho_{t1}^{0}$ into the addresses (s, t1+1) mentioned above.

Under the circumstances, the autocorrelation series calculator 62, the similarity measurement circuit 63, and the maximum similarity detector 64 calculates Equation (6). In this case, the random access memory of the autocorrelation series calculator 62 is loaded with the autocorrelation coefficients $\rho_{t1-8}^{8}$, $\rho_{t1-16}^{16}$, $\rho_{t1-24}^{24}$, $\rho_{t1-32}^{32}$, $\rho_{t1-40}^{40}$, $\rho_{t1-48}^{48}$, and so on which are necessary for calculations of Equation (6) in a manner similar to those of Equation (5). It is needless to say that the autocorrelation coefficients, such as $\rho_{-40}^{40}$, $\rho_{-48}^{48}$, $\rho_{-47}^{48}$, . . . , $\rho_{-40}^{48}$ are located outside of the defined range and are evaluated as zero.

The autocorrelation coefficient series mentioned on the righthand side of Equation (6) are summed up in preassigned addresses in the form of additions or subtractions to obtain accumulation results.

The accumulation results are delivered to the similarity measurement circuit 63 to be calculated or convoluted with the cross correlation coefficients ø(q) where q is variable between 0 and 15, both inclusive. As a result, the correlations of sixty-four in number specified by the righthand sides of Equation (6) are calculated to represent a degree of similarities and are sent to the maximum similarity detector 64.

The maximum similarity detector 64 detects a maximum one of the correlations in the above-mentioned manner and produces the polarity signal representative of either +1 or −1. The polarity signal is sent to the pulse polarity memory 65 and is memorized in the address (1, 2).

Thereafter, the maximum similarity series searching circuit 50 determined the polarity signal (depicted at sgn(16)) by the maximum similarity detector 64 in cooperation with the autocorrelation series calculator 62 and the similarity measurement circuit 63. In this case, the polarity signal sgn(16) is determined by the similarity measurement circuit 63 and the maximum similarity detector 64 with reference to the autocorrelation coefficient series $\rho_r^{0}$, $\rho_r^{8}$, $\rho_r^{16}$, $\rho_r^{24}$, $\rho_r^{32}$, $\rho_r^{40}$, $\rho_r^{48}$, and $\rho_r^{56}$ sent from the autocorrelation series calculator 62 and the cross correlation coefficient series ø(q) sent from the second memory 38. The polarity signal sgn(16) is memorized in the address (1, 3) of the pulse polarity memory 65.

In a like manner, the polarity signals depicted at sgn(24), sgn(32), . . . , sgn(248) are successively determined by the maximum similarity detector 64 and are memorized into the addresses (1, 4), (1, 5), . . . , (1, 32) of the pulse polarity memory 65.

The pulse sequence of the zeroth phase "0" is determined in the above-mentioned manner and is specified only by the polarities.

Subsequently, the maximum similarity series searching circuit 50 determines the pulse sequence of the first phase "1" which is specified by the polarity signals sgn(1), sgn(9), . . . , sgn(249) calculated by the use of the autocorrelation coefficients, such as $\rho_{-1}^{1}-\rho_{39}^{1}$, $\rho_{-9}^{9}-\rho_{39}^{9}$, $\rho_{-17}^{17}-\rho_{39}^{17}$, $\rho_{-25}^{25}-\rho_{39}^{25}$, $\rho_{-33}^{33}-\rho_{39}^{33}$, $\rho_{-39}^{41}-\rho_{39}^{41}$, $\rho_{-39}^{49}-\rho_{39}^{49}$, . . . , $\rho_{-39}^{286}-\rho_{-22}^{286}$, together with the cross correlation coefficients ø(q). The polarity signals sgn(1), sgn(9), . . . , sgn(249) are memorized in the addresses (2, 1)–(2, 32) of the pules polarity memory 65.

In a like manner, the illustrated maximum similarity series searching circuit 50 determines the pulse sequences of the second through the eighth phases "2" to "7" which are memorized in the addresses (3, 1)–(3, 32), (4, 1)–(4, 32), . . . , (8, 1)–(8, 32) of the pulse polarity memory 65.

Next, the autocorrelation series calculator 62 is supplied from the pulse polarity memory 65 and the fourth memory 48 with the pulse sequence sgn(0), sgn(8), . . . , sgn(248) of the zeroth phase "0" and with the autocorrelation coefficient series depicted at $\rho_r^{0}$, $\rho_r^{8}$, . . . , $\rho_r^{248}$ where r is variable between −39 and 39, both inclusive. Under the circumstances, the autocorrelation series calculator 62 carries out calculation given by:

$$\mathrm{sgn}\ (0)\rho_q^{0}+\mathrm{sgn}(8)\rho_{q-8}^{8}+\ldots+\mathrm{sgn}(248)\rho_{q-248}^{248}$$

where q is variable between 0 and 255, both inclusive. Consequently, calculation results of 256 in number are memorized in the addresses (1, 1)–(1, 256) of the random access memory in the autocorrelation series calculator 62 and are representative of summation of autocorrelation coefficients. Thereafter, the autocorrelation series calculator 62 carries out similar calculation in connection with the pulse sequence of the first phase "1" depicted at sgn(1), sgn(9), . . . , sgn(249) and the autocorrelation coefficient series $\rho_r^{1}$, $\rho_r^{9}$, . . . , $\rho_r^{249}$ where r is variable between −39 and 39 to obtain similar calculation results which are memorized in the addresses (2, 1)–(2, 256).

As regards the pulse sequences of the second through the seventh phases "2" to "7" the autocorrelation series calculator 62 carries out similar calculations to obtain similar calculation results and to memorize them into the addresses (3, 1)–(3, 256), (4, 1)–(4, 256), . . . , (8, 1)–(8, 256).

The similarity measurement circuit 62 is supplied from the autocorrelation series calculator 62 and the second memory 38 with eight sets of the autocorrelation coefficient series and the cross correlation coefficient series ø(q). Each set of the autocorrelation coefficient series and the cross correlation coefficient series are calculated in a convolution manner to attain eight data signals which are representative of degrees of similarities and which may be referred to as similarity data signals.

The similarity data,signals are sent to the maximum similarity detector 64 to detect the maximum one of the similarity data signals. When the maximum one of the similarity data signals is detected, the maximum similarity detector 64 supplies the pulse polarity memory 65 with a detection signal indicative of the pulse sequence corresponding to the maximum similarity data signal. Responsive to the detection signal, the pulse polarity memory 65 produces, as the excitation pulse sequence Bi, the pulse sequence indicated by the detection signal.

Referring to FIG. 2, the synthesizer 11 is communicable with the analyzer 10 illustrated with reference to FIG. 1 and is supplied as a reception data signal with the transmission data signal having the transmission bit rate of 2400 bits/second, as mentioned before. The reception data signal is received by a demultiplexer 91 and is demultiplexed like the transmission data signal at every frame into the quantized LSP parameters of thirty-five bits, the pulse phase signal of three bits, the pulse polarity signal of thirty-two bits, and the pulse amplitude signal of six bits all of which have been mentioned in conjunction with the analyzer 10 (FIG. 1) and which may be somewhat varied or modified during transmission due to noise or so. However, no distinction will be made between the transmission data signal and the reception data signal for brevity of description.

In the synthesizer 11, the quantized LSP parameters are delivered to an LSP decoder 92 while the pulse amplitude signal is delivered to an amplitude decoder 93. Moreover, both the pulse phase signal and the pulse polarity signal are sent to an exciting source generator 94. The amplitude decoder 93 decodes the pulse amplitude signal into a decoded amplitude which is supplied to the exciting source generator 94 supplied with the pulse phase signal and the pulse polarity signal from the demultiplexer 91. The exciting source generator 94 generates a sequence of reproduced pulses which has pulse phase and a pulse polarity indicated by the pulse phase signal and the pulse polarity signal, respectively, and which has an amplitude identical with the decoded amplitude lent from the amplitude decoder 93. The reproduced pulse sequence is sent to an LPC synthesizing filter 95 which is operable in response to a timing pulse sequence of 8 kHz.

On the other hand, the LSP decoder 92 decodes the quantized LSP parameters into a sequence of decoded LSP parameters which is sent to an interpolator 96 at every period of thirty-two milliseconds. The interpolator 96 itself carries out interpolation at every period of four milliseconds, namely, at an interpolation frequency of 250 Hz. In this connection, the interpolator 96 interpolates the decoded LSP parameters at every interpolation frequency of 250 Hz to produce a sequence of interpolated LSP parameters at every period of four milliseconds.

The interpolated LSP parameters are supplied to an $\omega/\alpha$ converter 97 to be converted into converted $\alpha$ parameters. The LPC synthesizing filter 95 has the converted $\alpha$ parameters and is excited by the reproduced pulse sequence to produce a sequence of quantized sample signals. The quantized sample signals are given to a digital-to-analog (D/A) converter 98 operable in response to a sequence of clock pulses having a clock frequency of 8 kHz. The D/A converter 98 converts the quantized sample signals into a converted analog signal which is sent as an output analog signal OUT to a low pass filter (not shown) to restrict the converted analog signal within a bandwidth of 3.4 kHz.

As mentioned before, the speech encoding system illustrated in FIGS. 1 and 2 represents exciting source information by the use of a sequence of pulses which is specified by a polarity and a pulse phase determined in response to the input speech signal and which appears in an equidistant time interval and an invariable pulse amplitude. With this structure, it is possible to encode a waveform at a low bit rate of, for example, 2.4 kb/s and to improve a speech quality in spite of such a low bit rate.

While this invention has thus far been described in conjunction with a preferred embodiment thereof, it will readily be possible for those skilled in the art to put this invention into practice in various other manners. For example, K parameters may be used as the LPC parameters instead of the LSP parameters.

What is claimed is:

1. A speech signal analyzer for use in analyzing an input speech signal to produce a sequence of transmission data signals which appears as a result of an analysis of said input speech signal in said speech signal analyzer, said speech signal analyzer comprising:

preliminary processing means supplied with said input speech signal for preliminarily processing said input speech signal to produce a sequence of processed digital signals which is extracted from said input speech signal and which is arranged within an analysis frame having a predetermined frame time interval;

parameter calculating means for calculating a sequence of preselected parameters at said analysis frame as regards said input speech signal to produce a parameter signal representative of said preselected parameter sequence;

impulse response calculating means supplied with said parameter signal for calculating impulse responses with reference to said parameter signal;

cross correlation coefficient calculating means supplied with said impulse responses and said processed digital signal sequence for calculating cross correlation coefficients between said impulse responses and said processed digital signal sequence within said analysis frame to produce cross correlation coefficient signals representative of said cross correlations coefficients;

autocorrelation coefficient calculating means for calculating series of autocorrelation coefficients of said impulse responses;

maximum similarity series extracting means, coupled to said cross correlation coefficient calculating means and said autocorrelation coefficient calculating means, for extracting a series of extracted excitation pulses from said series of autocorrelation coefficients, said series of extracted pulses extending across the predetermined time frame interval, each of the excitation pulses in the series of extracted excitation pulses appearing at a fixed equidistant time interval, and having a polarity, the excitation pulses of said series of excitation pulses being defined by a common phase, the series of extracted excitation pulses being selected from among other such excitation pulse series such that said series of the extracted excitation pulses exhibits a maximum similarity to said cross correlation coefficient signals, said maximum similarity series extracting means functions to produce signals representative of said series of extracted excitation pulses, including a phase signal representative of said phase;

transmitting means responsive to said series of extracted excitation pulses, said phase signal, and said parameter signal for transmitting said transmission data signal sequence in relation to said series of extracted excitation pulses and said phase signal together with said parameter signal.

2. A speech signal analyzer as claimed in claim 1, wherein said maximum similarity series extracting means comprises:

autocorrelation series calculating means for successively summing up the autocorrelation coefficients of each series to successively produce a summation result signal representative of a result of summation of the autocorrelation coefficients of each series;

similarity measuring means responsive to said summation result signal and said cross correlation coefficient signals for measuring a degree of similarities between the autocorrelation coefficients of each series and the cross correlation coefficients to determine each polarity of the excitation pulses by selecting the maximum similarity and to successively produce a sequence of the polarity signals at every one of provisional excitation pulse sequences which are different in phase from one another; and phase determining means responsive to said polarity signal sequences for determining the series of the extracted excitation pulses from said provisional excitation pulse series.

3. A speech signal analyzer as claimed in claim 2, said preselected parameters being specified by linear predictive coding parameters, wherein said parameter calculating means comprises:

interpolating means for interpolating said linear predictive coding parameters at every one of interpolation periods each of which is shorter than said analysis frame to produce a sequence of interpolated parameters obtained by interpolating the linear predictive coding parameters; and means for producing said interpolated parameters as said parameter signal.

4. A speech signal analyzer as claimed in claim 3, wherein said impulse response calculating means comprises:

calculation means coupled to said interpolating means for calculating the impulse responses of an all-pole filter defined by said interpolated parameters; and means for supplying said impulse responses to said cross correlation coefficient calculating means and said autocorrelation coefficient calculating means.

5. A speech signal analyzer as claimed in claim 1, wherein said preliminary processing means comprises:

spectrum modifying means for modifying said input speech signal in its spectrum into a modified speech signal with reference to said predetermined parameters and attenuated parameters calculated on the basis of said predetermined parameters; and means for producing said modified speech signal as said digital signal sequence.

6. A speech signal analyzer as claimed in claim 1, further comprising:

parameter synthesizing means supplied with said excitation pules sequence and said parameter signal for locally decoding said excitation pulse sequence into a local decoded speech signal:

said preliminary processing means further comprising:

compensating means supplied with said analysis frame and coupled to said parameter synthesizing means for compensating said analysis frame at a boundary portion adjacent to a following frame to produce a compensated digital signal sequence as said digital signal sequence.

7. A speech signal analyzer as claimed in claim 1, wherein said preliminary processing means comprises:

window means for defining a window which has a time interval longer than said analysis frame.

8. A speech signal synthesizer communicable with said speech signal analyzer claimed in claim 1, comprising:

exciting source signal reproducing means for reproducing exciting source information on the basis of said pulse phase signal and said polarity signal included in said transmission data signal sequence;

parameter reproducing means for reproducing said parameter signals from said transmission data signal sequence to produce reproduced parameter signals; and synthesizing means coupled to said exciting source signal reproducing means and said parameter reproducing means for synthesizing a sequence of reproduced digital speech signals from said exciting source signal with reference to said reproduced parameter signals.

9. A speech signal synthesizer as claimed in claim 8, wherein said parameter reproducing means comprises:

means for decoding said parameter signals into decoded parameter signals;

compensating means for compensating said parameter signals at a predetermined period to produce a sequence of compensated parameter signals as said reproduced parameter signals.

10. A speech signal encoding system comprising an analyzing side for analyzing a speech signal into a set of analyzed data signals and a synthesizing side for synthesizing said speech signal from the set of said analyzed data signals, said speech signal being given in the form of a sequence of digital speech signals divisible into a plurality of frames, said analyzing side comprising:

LPC analyzing means supplied with said digital speech signals for carrying out linear prediction of said digital speech signals at every one of said frames to produce a sequence of linear prediction coding coefficients;

impulse response calculating means for calculating impulse responses of an all-pole filter defined by said linear prediction coding coefficients;

cross-correlation calculation means for calculating cross-correlations between said impulse responses and the digital speech signals in each of said frames to produce a set of cross-correlation coefficients;

autocorrelation calculation means for calculating autocorrelations of said impulse responses to produce a set of autocorrelation coefficients;

pulse searching means supplied with the set of the cross-correlation coefficients and the set of the autocorrelation coefficients for processing the set of the cross-correlation coefficients and the set of the autocorrelation coefficients to calculate a plurality of pulse series which are different in phase from one another and which are composed of polar pulses having an identical fixed pulse period and an amplitude and polarities and to search for each polarity of the polar pulses in the plurality of the pulse series to determine the pulse series that has a most resembled series to the series of said cross-correlation coefficients in a combination of the polarities of the pulse series;

pulse series phase searching means for searching for a most likelihood pulse series most nearest to said cross-correlation coefficient series selected from the plurality of the pulse series each of which has the polar pulse obtained by the above-mentioned searching operation of said pulse polarity searching means; and transmitting means for transmitting pulse information obtained by searching operation of said pulse series phase searching means and the linear prediction coding coefficients as said set of said analyzed data signals;

said synthesizing side comprising:

exciting source generating means for generating a sequence of exciting source pulses in response to the pulse series information; and first LPC synthesizing means for synthesizing a reproduction of said speech signal by the use of the LPC coefficients.

* * * * *

UNITED STATES PATENT AND TRADEMARK OFFICE

CERTIFICATE OF CORRECTION

| | | |
|---|---|---|
| PATENT NO. | : | 5,557,705 |
| DATED | : | September 17, 1996 |
| INVENTOR(S) | : | Tetsu TAGUCHI |

It is certified that error(s) appears in the above-identified patent and that said Letters Patent is hereby corrected as shown below:

Column 4, line 18, delete "bite" and insert --bits--.

Column 6, line 20, delete "An" and insert --in--.

Column 7, line 20, delete " $\rho_\tau{}^q = \sum_{v=-39}^{39} U_v{}^q U_{v+\tau}^q$ " and insert -- $\rho_\tau{}^q = \sum_{v=-39}^{39} U_v{}^q U_{v+\tau}{}^q$ --.

Column 9, line 20, delete "tΘo" and insert --t0--

Column 11, line 54, delete "pules" and insert --pulse--.

Column 12, line 54, delete "40".

Column 13, line 31, delete "addressee" and insert --addresses--.

Signed and Sealed this

Fourth Day of February, 1997

*Attest:*

*Attesting Officer*

BRUCE LEHMAN

*Commissioner of Patents and Trademarks*